US006236818B1

(12) United States Patent
Endo et al.

(10) Patent No.: US 6,236,818 B1
(45) Date of Patent: May 22, 2001

(54) DEVELOPING DEVICE WITH TIMING CONTROL

(75) Inventors: Yoshinori Endo, Toyota; Kenjiro Nishiwaki; Tomoaki Hattori, both of Nagoya, all of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/030,963

(22) Filed: Feb. 26, 1998

(30) Foreign Application Priority Data

Feb. 28, 1997 (JP) ..... 9-046606
Feb. 28, 1997 (JP) ..... 9-046646
Feb. 28, 1997 (JP) ..... 9-046731

(51) Int. Cl.[7] ..... G03G 15/06
(52) U.S. Cl. ..... 399/55; 399/285
(58) Field of Search ..... 399/53–55, 252, 399/272, 274, 279, 281–286, 43

(56) References Cited

U.S. PATENT DOCUMENTS 4,466,732 * 8/1984 Folkins ..... 399/252 X
5,138,385 8/1992 Toyoshi et al. .
5,324,884 6/1994 Honda et al. .
5,365,318 11/1994 Hiraoka et al. .
5,473,417 12/1995 Hirano .
5,557,379 9/1996 Nakamura et al. .
6,026,266 * 2/2000 Sakai et al. ..... 399/281

FOREIGN PATENT DOCUMENTS 6-51624 * 2/1994 (JP) .
8-179602 7/1996 (JP) .
9-106172 4/1997 (JP) .
2956598 * 7/1980 (SU) .

* cited by examiner

*Primary Examiner*—Quana M. Grainger
(74) *Attorney, Agent, or Firm*—Oliff & Berridge, PLC

(57) ABSTRACT

The laser printer 1 comprises a CPU 61 for controlling each components, a ROM 62 for storing control programs, a control circuit 66 constituted of ASIC and the like, a high-voltage power circuit 67 for applying high bias voltage to a developing roller 27, a DC power circuit 69 for applying bias voltage to a toner supply roller 31, a constant-current control device 68 for conducting a constant-current control with respect to the DC power circuit 69.

26 Claims, 14 Drawing Sheets

FIG.4(B)

| | |
|---|---|
| S1 | COUNTED VALUE OF PRINTED PAPER |
| S2 | TONER CARTRIDGE IS EMPTY ? |
| S3 | TONER CARTRIDGE HAS BEEN REPLACED ? |
| S4 | CHANGE COUNTED VALUE OF PRINTED SHEETS TO "0" |
| S5 | TURN ON BIAS VOLTAGE FOR SUPPLY ROLLER |
| S6 | START PRINTING |
| S7 | ONE-SHEET-PRINTING IS COMPLETED ? |
| S8 | TURN OFF BIAS VOLTAGE FOR SUPPLY ROLLER |
| S9 | ADD "1" TO COUNTED VALUE OF PRINTED SHEETS |
| S10 | PRINTING IS COMPLETED ? |
| S11 | START PRINTING |
| S12 | ONE-SHEET-PRINTING IS COMPLETED ? |
| S13 | ADD "1" TO COUNTED VALUE OF PRINTED SHEETS |
| S14 | PRINTING IS COMPLETED ? |

FIG.7(B)

| | |
|---|---|
| S21 | REPLACEMENT OF PROCESS UNIT ? |
| S24 | TONER CARTRIDGE IS EMPTY ? |
| S25 | READ COUNT VALUE |
| S26 | COUNT VALUE = 0 ? |
| S27 | START PRINTING |
| S28 | PHOTOSENSITIVE DRUM HAS BEEN ROTATED FOR ONE SHEET |
| S29 | ADD "1" TO THE CUMULATIVE NUMBER OF PRINTED SHEETS |
| S30 | PRINTING IS COMPLETED ? |
| S31 | TONER CARTRIDGE HAS BEEN REPLACED ? |
| S32 | READ THE NUMBER OF PRINTING SHEETS FOR VOLTAGE APPLICATION ACCORDING TO THE CUMULATIVE NUMBER OF PRINTED SHEETS |
| S33 | STORE THE NUMBER OF PRINTING SHEETS AS COUNT VALUE |
| S22 | PROCESS UNIT HAS BEEN REPLACED ? |
| S23 | CHANGE THE CUMULATIVE NUMBER OF PRINTED SHEETS TO "0" |
| S34 | TURN ON BIAS VOLTAGE TO TONER SUPPLY ROLLER |
| S35 | START PRINTING |
| S36 | PHOTOSENSITIVE DRUM HAS BEEN ROTATED FOR ONE SHEET |
| S38 | SUBTRACT "1" FROM COUNT VALUE |
| S39 | TURN OFF BIAS VOLTAGE TO TONER SUPPLY ROLLER |

FIG.8

| REFFRENCE VALUES RELATING TO THE CUMULATIVE NUMBER OF PRINTED SHEETS, CONVERTED FROM THE NUMBER OF ROTATION OF PHOTOSENSITIVE DRUM | THE NUMBER OF PRINTING PAPER SHEETS FOR WHICH BIAS VOLTAGE IS APPLIED TO TONER SUPPLY ROLLER (AFTER REPLACEMENT OF TONER CARTRIDGE) |
|---|---|
| 0 (CORRESPONDING TO NEW DRUM) | 0 (NO VOLTAGE APPLICATION) |
| 1～1000 | 10 |
| 1001～2500 | 20 |
| 2501～5000 | 30 |
| 5001～8000 | 40 |
| 8001～9000 | 50 |
| 9001 OR MORE | 60 |

FIG.9(B)

| | |
|---|---|
| S41 | REPLACEMENT OF PROCESS UNIT ? |
| S42 | PROCESS UNIT HAS BEEN REPLACED ? |
| S43 | CHANGE THE CUMULATIVE NUMBER OF PRINTED SHEETS TO "0" |
| S44 | TONER CARTRIDGE IS EMPTY ? |
| S45 | READ COUNT VALUE |
| S46 | COUNT VALUE = 0 ? |
| S47 | START PRINTING |
| S48 | PHOTOSENSITIVE DRUM HAS BEEN ROTATED FOR ONE SHEET ? |
| S49 | ADD "1" TO THE CUMULATIVE NUMBER OF PRINTED SHEETS |
| S50 | PRINTING IS COMPLETED ? |
| S51 | TONER CARTRIDGE HAS BEEN REPLACED ? |
| S52 | READ THE NUMBER OF PRINTING SHEETS FOR VOLTAGE APPLICATION ACCORDING TO THE CUMULATIVE NUMBER OF PRINTED SHEETS |
| S53 | STORE THE NUMBER OF PRINTING SHEET AS COUNT VALUE |
| S54 | TURN ON BIAS VOLTAGE TO TONER SUPPLY ROLLER |
| S55 | START PRINTING |
| S56 | VOLTAGE APPLICATION TIME HAS PASSED ? |
| S57 | TURN OFF BIAS VOLTAGE TO TONER SUPPLY ROLLER |
| S58 | SUBTRACT "1" FROM COUNT VALUE |

DEVELOPING DEVICE WITH TIMING CONTROL

BACKGROUND OF THE INVENTION

1. Field of the Invention

The present invention relates to a developing device for use in an image forming apparatus such as a laser printer for performing an image formation by supplying toner to an electrostatic latent image formed on a circumferential surface of a photosensitive drum, developing the image, and transferring the developed image onto a paper sheet. In particular, the present invention relates to a developing device capable of applying bias voltage to a supply roller for supplying toner onto a developing roller, whereby charged toner is transferred to the developing roller.

The present invention also relates to a developing device for an image forming apparatus capable of easily controlling a direct-current (DC) power device for a constant-current, the DC power device being connected to a toner supply roller, regardless of variation of a resistance value between a developing roller and the supply roller, to prevent breakage of the DC power device even when it stops, thereby to form a visual image with a good image quality.

Furthermore, the present invention relates to a developing device for an image forming apparatus capable of effectively preventing poorly charged toner which is produced in a toner storing unit after toner supply from adhering to the developing roller even when a surface deterioration of the developing roller caused due to aging and an increase of deteriorated toner remaining in a developing chamber, thereby to form a visual image with a good image quality.

2. Description of Related Art

Heretofore, there have been proposed various types of developing device for an image forming apparatus, e.g., a laser printer and the like. The developing device is generally constituted of a toner storing unit including a toner cartridge, an auger member for dispersing the toner supplied from the toner storing unit into a developing chamber, a toner supply roller for supplying the dispersed toner, a developing roller for performing toner development by providing the toner supplied by the toner supply roller onto an electrostatic latent image formed on a circumferential surface of a photosensitive drum. One example of a toner supply device as the developing device is shown in FIG. 11. FIG. 11 is an explanatory view showing a schematic sectional view of a main part of the developing device for an image forming apparatus in the prior art.

In FIG. 11, the toner supply device has a toner cartridge 100 which accommodates therein toner. The toner cartridge 100 is provided with a toner exhaust port at an axial center portion of the cartridge 100. In the toner cartridge 100, disposed is an agitator 103 for agitating toner to supply it through the toner exhaust port to a developing chamber 102 side. In a frame F, a toner introduction port is formed corresponding to the toner exhaust port of the toner cartridge 100, both ports constituting a toner supply port 101. The frame F includes an upper frame F1 and a lower frame F2 which form a closed developing chamber 102. In this developing chamber 102, two auger members 109 and 110 are rotatably disposed near the toner supply port 101 (at a right side in FIG. 5), to uniformly spread the toner supplied through the toner supply port 101 in the developing chamber 102.

At a lower side in the developing chamber 102, a toner supply roller 104 is rotatably disposed and a developing roller 105 is rotatably arranged facing the supply roller 104. This toner supply roller 104 serves to supply the toner transported through the toner supply port 101 to the developing roller 105. Here, the toner supply roller 104 comprises a roller shaft 104A made of metal (steel materials of various kinds) and a conductive sponge member 104B for surrounding a periphery of the roller shaft 104A. The developing roller 105 comprises a roller shaft 105A made of metal (steel materials of various kinds) and a conductive rubber member 105B which is generally harder than the conductive rubber member 104B and is provided surrounding the roller shaft 105A. At the time of toner supply from the toner supply roller 104 to the developing roller 105, the toner supply roller 104 is in contact with the developing roller 105 such that the conductive sponge member 104B is somewhat compressed to the conductive rubber member 105B.

To the roller shaft 105A of the developing roller 105, a constant bias voltage is applied from a constant voltage DC power device 112. To the roller shaft 104A of the toner supply roller 104, similarly, a constant bias voltage is applied from a constant voltage DC power device 111 so that the charged toner in the toner cartridge 100 is made to move from the toner supply roller 104 to the developing roller 105.

Such the application of bias voltage to the supply roller 104 can cause active transfer of the toner having a good electrification property onto the developing roller 105. Even when a larger amount of fresh toner which is not charged satisfactorily is supplied to the developing chamber 102. Accordingly, it is possible to prevent selective collection and supply of only the insufficiently charged toner with respect to the developing roller 105, and the occurrence of fogging which may be caused by the toner supply of a large amount of the insufficiently charged toner to the developing roller 105.

A blade 107 is secured on an inner wall of the upper frame F1, above the developing roller 105, by a fixing member 106. This blade 107 serves to regulate the thickness of a toner layer formed on a circumferential outer surface of the developing roller 105. The developing roller 105 is disposed so as to be in contact with a photosensitive drum 108. An electrostatic latent image can be formed on a circumferential outer surface of the photosensitive drum 108 by a light exposure unit (not shown) which scans the surface of the drum 108 with laser light in accordance with image data. The developing roller 105 then performs toner development by supplying toner on the electrostatic latent image formed on the surface of the photosensitive drum 108. The developed image is transferred onto a paper sheet fed from a paper supply unit (not shown) to print an image thereon.

However, in the conventional developing device for an image forming apparatus, as an operation time thereof becomes longer, insulating materials, e.g., silica, etc. covering toner particles tend to adhere to respective surfaces of the conductive sponge member 104B of the toner supply roller 104 and the conductive rubber member 105 of the developing roller 105, thus forming an insulating film on the surfaces of the members 104 and 105. The bias voltage are to be applied from the constant voltage DC power device 111 and 112 to the toner supply roller 104 and the developing roller 105 respectively, so that a difference between those bias voltages is constant. The insulating film causes the current passing between the toner supply roller 104 and the developing roller 105 to become minute (for instance, 0.1 $\mu$A or less) or zero, thus resulting in a problem of preventing the transfer of the toner positively charged by an electrical field from the supply roller 104 to the developing roller 105.

If a sufficient amount of toner is not carried on the conductive sponge member 104B, the resistance between the supply roller 104 and the developing roller 105 decreases (for instance, 2 MΩ or less), allowing an overcurrent (e.g., 50 μA or more) to flow therebetween. This can result in overcharging of toner carried on the sponge member 104B or local accumulation of toner negatively charged.

Even when the constant voltage DC power device 111 for applying bias voltage to the toner supply roller 104 is exchanged to a DC power device for a constant-current control, there is a problem that the output voltage becomes less than the voltage that the DC device can control if the resistance (for instance, 2 MΩ or less) between the supply roller 104 and the developing roller 105 decreases.

When the DC device for applying bias voltage to the supply roller 104 is turned off, the electric potential of the DC device becomes 0V, allowing reverse current to flow between the supply roller 104 and the developing roller 105. This results in transfer of the reversely charged toner to the developing roller 105.

The bias voltage with respect to the toner supply roller 104 is constantly applied from the constant-voltage DC power device 111, which always consumes electric power.

Furthermore, constant application of bias voltage to the supply roller 104 enables an increase of sufficiently charged toner, resulting in no chance of supplying a large amount of insufficiently charged toner to the developing roller 105; however, only the toner which has a good electrification property is supplied to the developing roller 105, and also the toner which has a poor electrification property is not consumed and such the toner will be accumulated in the developing chamber 102.

SUMMARY OF THE INVENTION

The present invention has been made in view of the above circumstances and has an object to overcome the above problems and to provide a developing device for an image forming apparatus in which bias voltage to be applied to a roller shaft of a toner supply roller is controlled for a constant current to ensure transfer of regularly charged toner carried on a conductive sponge member to a developing roller even when a resistance value between the toner supply roller and the developing roller largely varies due to the insulating film and the like, and to achieve a constant image formation with a good image quality.

Another object of the present invention is to provide a developing device for an image forming apparatus in which a resistor and a diode are connected in series with a circuit connecting a toner supply roller and a DC power device for applying bias voltage to the toner supply roller for constant-current control, whereby the DC device can control voltage even when a resistance value between the supply roller and the developing roller decreases as mentioned above, and also the reverse current can be prevented from flowing between the toner supply roller and the developing roller even when the DC power device is stopped, thereby to prevent transfer of reversely charged toner to the developing roller. This can achieve a constant image formation with a good image quality.

A third object of the present invention is to provide a developing device for an image forming apparatus wherein bias voltage is applied to a toner supply roller only until the predetermined number of paper sheets are printed after toner supply in order to reduce a power consumption of the image forming apparatus.

A fourth object of the present invention is to provide a developing device for an image forming apparatus capable of effectively preventing adhesion of a large amount of poorly charged toner with respect to a developing roller after toner supply and also preventing accumulation of the toner having a bad charging property in a developing chamber.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a developing device for an image forming apparatus for performing an image formation by an electrophotography process according to the present invention, the developing device comprising, a unit frame, a toner storing portion disposed inside the unit frame, a photosensitive body disposed in the unit frame, a developing roller for supplying toner to an electrostatic latent image formed on the photosensitive body to develop it, disposed rotatably around a roller shaft and facing to the photosensitive body, a first voltage application device for applying a first bias voltage to the roller shaft of the developing roller, a supply roller for supplying toner from the toner storing portion to the developing roller, disposed rotatably around a roller shaft and facing to the developing roller, a second voltage application device for applying a second bias voltage to the roller shaft of the supply roller so as to cause charged toner to move from the supply roller to the developing roller, and a constant-current controller for conducting constant control of the second voltage application device to apply the second bias voltage having a predetermined current value from the second voltage application device to the roller shaft of the supply roller.

In the developing device constructed as above, the DC device for applying bias voltage to a roller shaft of a supply roller is controlled for a constant current, so that a predetermined current value of current can be allowed to flow between the supply roller and the developing roller even when an insulating film and the like is formed on each surface of the supply roller and the developing roller, ensuring the transfer of the regularly charged toner which is carried on a conductive sponge member of the supply roller to the developing roller, thus enabling a constant image formation with a good image quality.

According to another aspect of the invention, there is provided a developing device for an image forming apparatus for performing an image formation by an electrophotography process, the developing device comprising a unit frame, a toner storing portion disposed inside the unit frame, a photosensitive body disposed in the unit frame, a developing roller for supplying toner to an electrostatic latent image formed on the photosensitive body to develop it, disposed rotatably around a roller shaft and facing to the photosensitive body, a first voltage application device for applying a first bias voltage to the roller shaft of the developing roller, a supply roller for supplying toner from the toner storing portion to the developing roller, disposed rotatably around a roller shaft and facing to the developing roller, a second voltage application device for applying a second bias voltage to the roller shaft of the supply roller so as to cause charged toner to move from the supply roller to the developing roller, first detection means for detecting a number of printed paper sheets on which the image formation is performed through the photosensitive body, second detection means for detecting whether the toner storing portion has been supplied with toner, judgement means for judging whether the number of printed paper sheets detected by the first detection means reaches a predetermined value, and control means for applying the second bias voltage to the roller shaft of the supply roller through the second voltage application device until the judgement means detects that the number of printed paper sheets has reached the predetermined value after the second detection means detects that the toner storing portion has been supplied with toner.

In the developing device constructed as above, after toner supply detecting means detects the necessity of toner provision to the toner storing unit, the print number detecting means counts the number of printed sheets and applies bias voltage to the roller shaft of the supply roller until the number of printed sheets reaches the predetermined number.

Accordingly, sufficiently charged toner can be selectively supplied to the developing roller at the time of toner supply, to prevent a large amount of poorly charged toner from being supplied to the developing roller. Since sufficiently charged toner increases when the number of printed sheets reaches the predetermined number, a large amount of poorly charged toner can be prevented from being supplied to the developing roller even without application of bias voltage, and the toner having a bad electrification property is also properly consumed, thus preventing accumulation thereof. Furthermore, the power consumption of the second bias applying means of the image forming apparatus can be reduced.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings,

FIG. 8 is a data table showing count values relating to the number of printing sheets for which bias voltage is to be applied every after replacement of toner cartridges in the third embodiment, which correspond to values relating to the cumulative number of printed sheets;

DETAILED DESCRIPTION OF THE PREFERRED EMBODIMENTS

Figure 1:
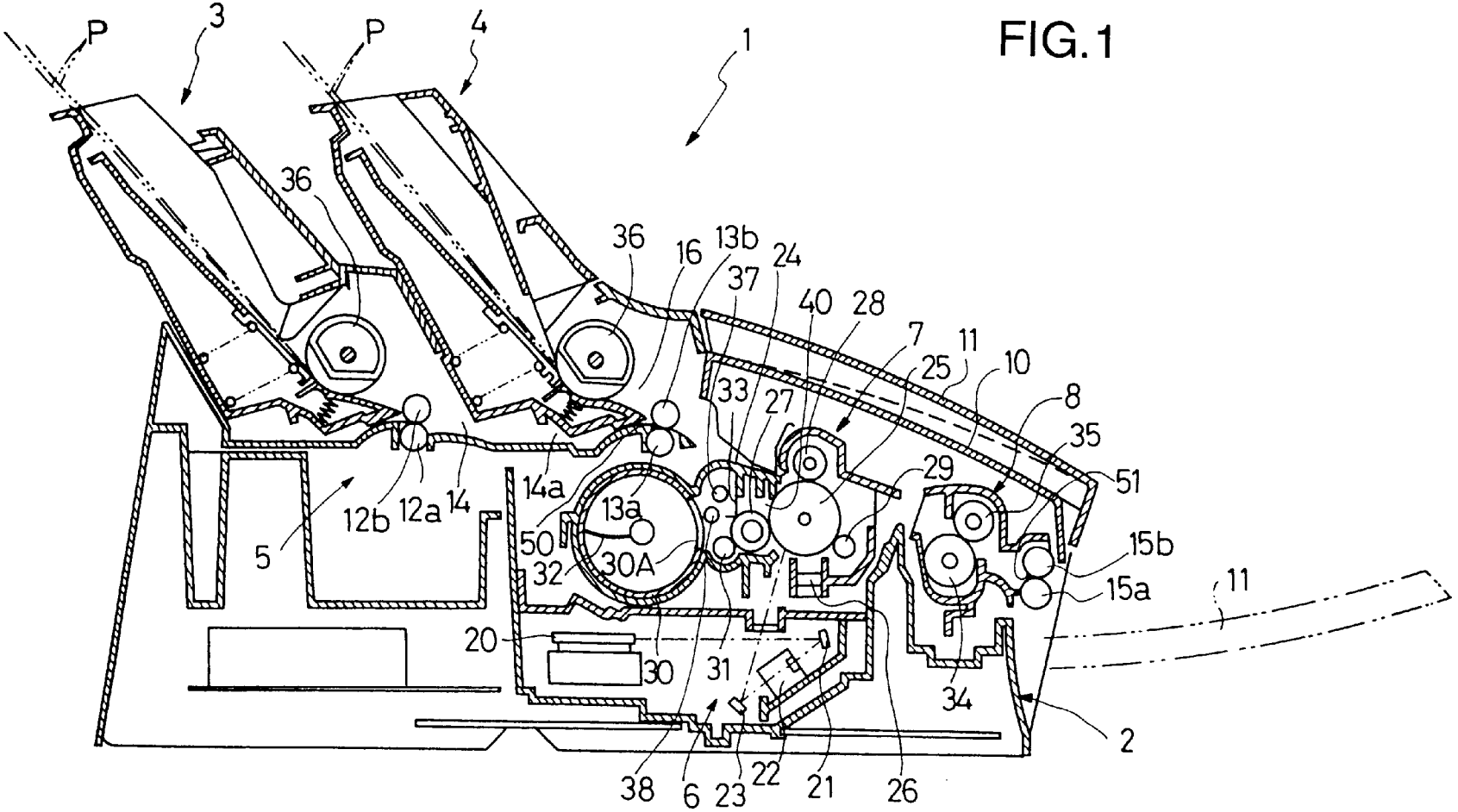
FIG. 1 is a sectional side view of a laser printer in a first embodiment according to the present invention.

A detailed description of preferred embodiments of a laser printer embodying a developing device for an image forming apparatus according to the present invention will now be given referring to the accompanying drawings. First, a schematic structure of the laser printer will be described with reference to FIG. 1. FIG. 1 is a sectional side view of the laser printer.

In FIG. 1, the laser printer 1 is provided with a main frame 2, a first paper tray 3 and a second paper tray 4 both provided on an upper surface of a rear end side of the main frame 2, a paper feeding mechanism 5 provided in the main frame 2, a scanner unit 6, a process unit 7, a fixing unit 8, and driving units for driving the first and second paper trays 3 and 4 and the paper feeding mechanism 5. Those driving units, not illustrated, are disposed at a left side in the main frame 2. Provided on a front side upper portion of the main frame 2 are a top cover 10 which can be opened to expose a printing mechanism and a paper discharge tray 11. This paper discharge tray 11 can switch its position between a closed position and an open position, acting as a tray for receiving printed paper at the open position.

It is noted that the scanner unit 6, the process unit 7, and the fixing unit 8 correspond to the printing mechanism. The process unit 7 is provided with a photosensitive drum 25, a charger 26, a developing roller 27, a transfer roller 28, a cleaning roller 29, and others, those members being housed in a casing 24. The process unit 7 is formed as a cartridge structure that can be set detachably in a predetermined position of the main frame 2.

The first paper tray 3 is fixedly provided on a rear upper portion of the main frame 2. The second paper tray 4 is provided detachably from an upper side of the main frame 2, ahead of the first paper tray 3. The paper feeding mechanism 5 is for feeding individual paper P selectively supplied from the first and second paper trays 3 and 4 toward the process unit 7. The paper feeding mechanism 5 has a pair of feed rollers 12*a* and 12*b* disposed downstream of the first paper tray 3 and a pair of resist rollers 13*a* and 13*b* disposed downstream of the second paper tray 4. The feed roller 12*a* is a driving roller and the feed roller 12*b* is a sub-roller. The resist roller 13*a* is a driving roller and the resist roller 13*b* is a sub-roller. A paper sensor 50 is disposed near an axial center portion of the resist roller 13*a*. A paper feed path 14 from the first paper tray 13 to the resist rollers 13*a* and 13*b* includes a lower side feed path 14*a* extending along a lower surface of the second paper tray 4, whereby the lower side feed path 14*a* can be opened with respect to the outside when the second paper tray 4 is detached from the main frame 2.

The paper P supplied through a pick-up roller 36 from the fist paper tray 3 is transported by the feed rollers 12*a* and 12*b* along the lower side feed path 14*a* and reaches the resist rollers 13*a* and 13*b* which provide resistance to the paper P, where the paper sensor 50 detects the passage of the paper P, and then the paper P is transported to the process unit 7. The paper P supplied through another pick-up roller 36 from the second supply tray 4 is also transported to the resist rollers 13*a* and 13*b* which provide resistance to the paper P, where the paper sensor 50 detects the passage of the paper P, and transported to the process unit 7.

The scanner unit 6 is disposed under the process unit 7 and includes a laser emitting portion not shown, a polygon mirror 20, reflection mirrors 21 and 24, and a plurality of lenses 22, etc. A laser beam emitted from the laser emitting portion is directed, along a chain line in FIG. 1, via the polygon mirror 20, the reflection mirror 21, the lens 22, and the reflection mirror 23 toward the process cartridge 7 to expose a circumferential outer surface of the electrically charged photosensitive drum 25 in rotation by a high-speed scanning to form an electrostatic latent image on the surface of the photosensitive drum 25.

Figure 2:
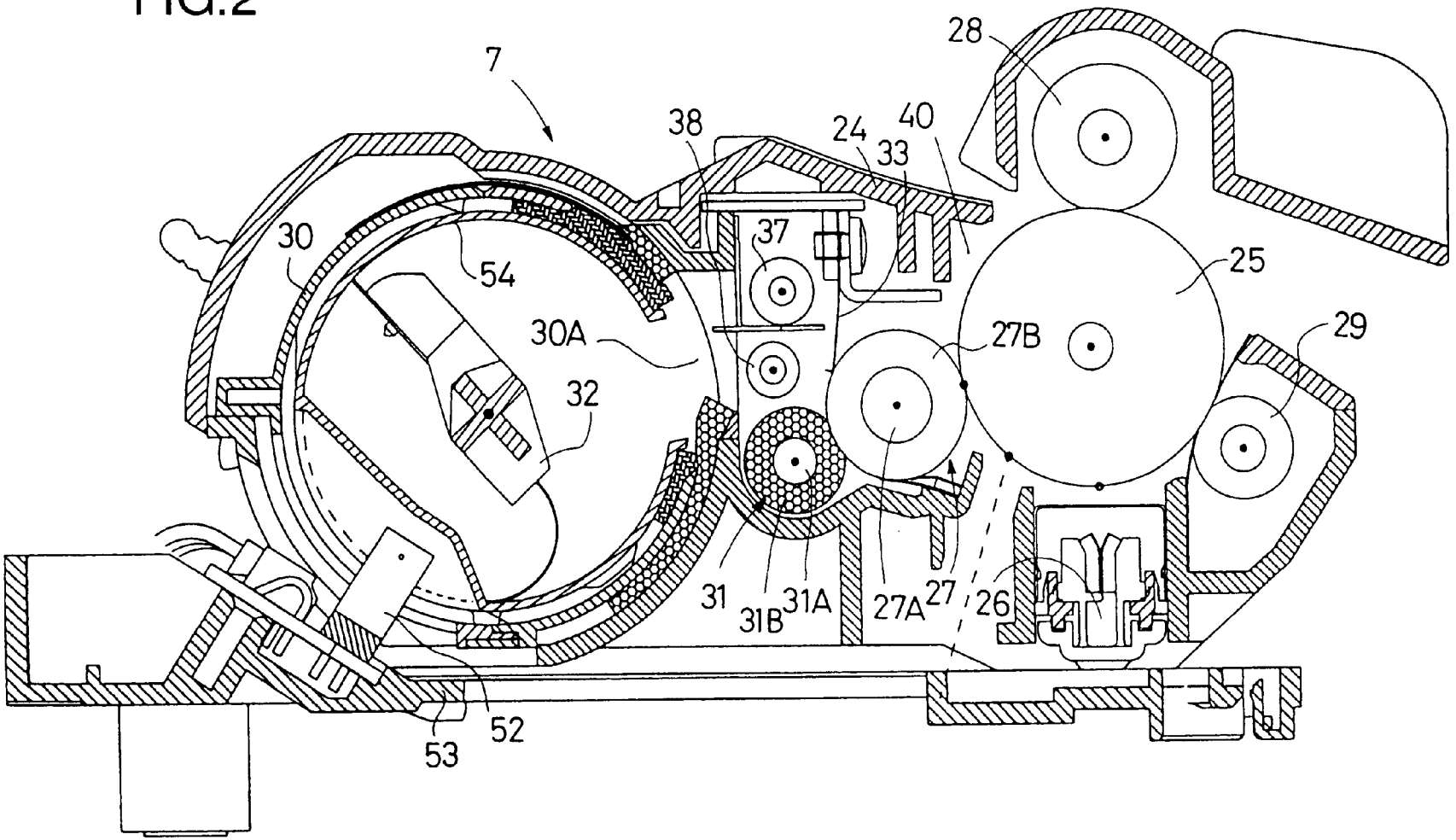
FIG. 2 is an enlarged sectional side view of a process unit in the laser printer in the first embodiment.

The process unit 7, as shown in FIG. 2, includes the casing 24, the photosensitive drum 25, the scorotron type charger 26, the developing roller 27, the transfer roller 28, the cleaning roller 29, a toner box 30, and the toner supply roller 31, etc., all of which are disposed inside the casing 24. Upon detachment of the process unit 7 from the main frame 2, a toner cartridge 54 (see FIG. 2) can be set in the toner box 30 to supply toner therein. Toner in the toner cartridge 54 is agitated and flicked by an agitator 32 to be supplied to a toner supply roller 31 through a port 30A serving as a toner exhaust port of the toner box 30 and then to the developing roller 27. The toner is carried on the developing roller 27, forming a toner layer with a predetermined thickness regulated by a blade 33, and is supplied to the photosensitive drum 25. It is noted that at a position close to the port 30A of the toner box 30 are rotatably disposed two auger members 37 and 38 for uniformly dispensing the toner flicked through the port 30A into the casing 24.

The toner supply roller 31, the developing roller 27, and the photosensitive drum 25 and others are controlled to rotate or stop every printing operation to form an image on paper P.

The developing roller 27 offers the toner to the electrostatic latent image formed on the surface of the photosensitive drum 25 to develop the electrostatic latent image, forming a visual image. The developed image is transferred onto the paper P passing between the photosensitive drum 25 and the transfer roller 28 and is fixed thereon in the fixing unit 8. Note that the toner remaining on the surface of the photosensitive drum 25 is once collected by the cleaning roller 29 and then is collected through the photosensitive drum 25 to the developing roller 27.

The fixing unit 8 for performing heat-fixing of toner on the paper P has a heat roller 34, a pressure roller 35 which is in pressure contact with the heat roller 34, a pair of discharge rollers 15*a* and 15*b* for discharging the paper P to the outside of the main frame 2. The discharge rollers 15*a* and 15*b* are disposed downstream of the rollers 34 and 35. A sensor 51 for detecting the discharge of paper P to the outside is disposed near an axial center portion of the discharge roller 15*a*.

It is noted that the feed speed (a first feed speed) at which the paper P is fed by the photosensitive drum 25 and the transfer roller 28 in the process unit 7 is set to be equal to or larger than the feed speed (a second feed speed) at which the paper P is fed through the heat roller 34, the pressure roller 35, and the discharge rollers 15*a* and 15*b* in the fixing unit 8. This is because there is a possibility that the second feed speed larger than the first feed speed causes pulling of the paper P at a nip point between the photosensitive drum 25 and the transfer roller 28, resulting in positional displacement of the image to be formed on the paper P when the toner image formed on the photosensitive drum 25 is transferred to the paper P, thus causing blur of the visual image.

Next, a structure of the process unit 7 will be explained with reference to FIG. 2. FIG. 2 is an enlarged sectional side view showing the process unit 7.

In FIG. 2, a toner supply roller 31 is rotatably disposed at a lower side in a developing chamber 40. A developing roller 27 is also rotatably disposed opposite to the toner supply roller 31. This toner supply roller 31 serves to supply the toner transported through a toner supply port 30A to the developing roller 27. The toner supply roller 31 is constituted of a roller shaft 31A made of metal (for instance, steel materials of various kinds) and a conductive sponge member 31B which surrounds the roller shaft 31A. The developing roller 27 is constituted of a roller shaft 27A made of metal (for instance, steel materials of various kinds) and a conductive rubber member 27B which is generally harder than the conductive sponge member 31B and formed around the roller shaft 27A. Accordingly, at the time of the toner supply from the toner supply roller 31 to the developing roller 27, the supply roller 31 is in contact with the developing roller 27 such that the conductive sponge member 31B is somewhat compressed with respect to the conductive rubber member 27B.

A toner sensor 52 for detecting an amount of toner in a toner cartridge 54 is mounted under an axial center portion of the toner box 30 (at a lower left side in FIG. 2). This toner sensor 52 is soldered on a circuit board and screwed on a scanner cover 53. The toner sensor 52 is constituted of an LED and a photosensor disposed so that a lower part of the toner cartridge 54 is inserted therebetween, which detects an amount of light penetrating through the toner cartridge 54 to detect the toner amount therein.

Figure 3:
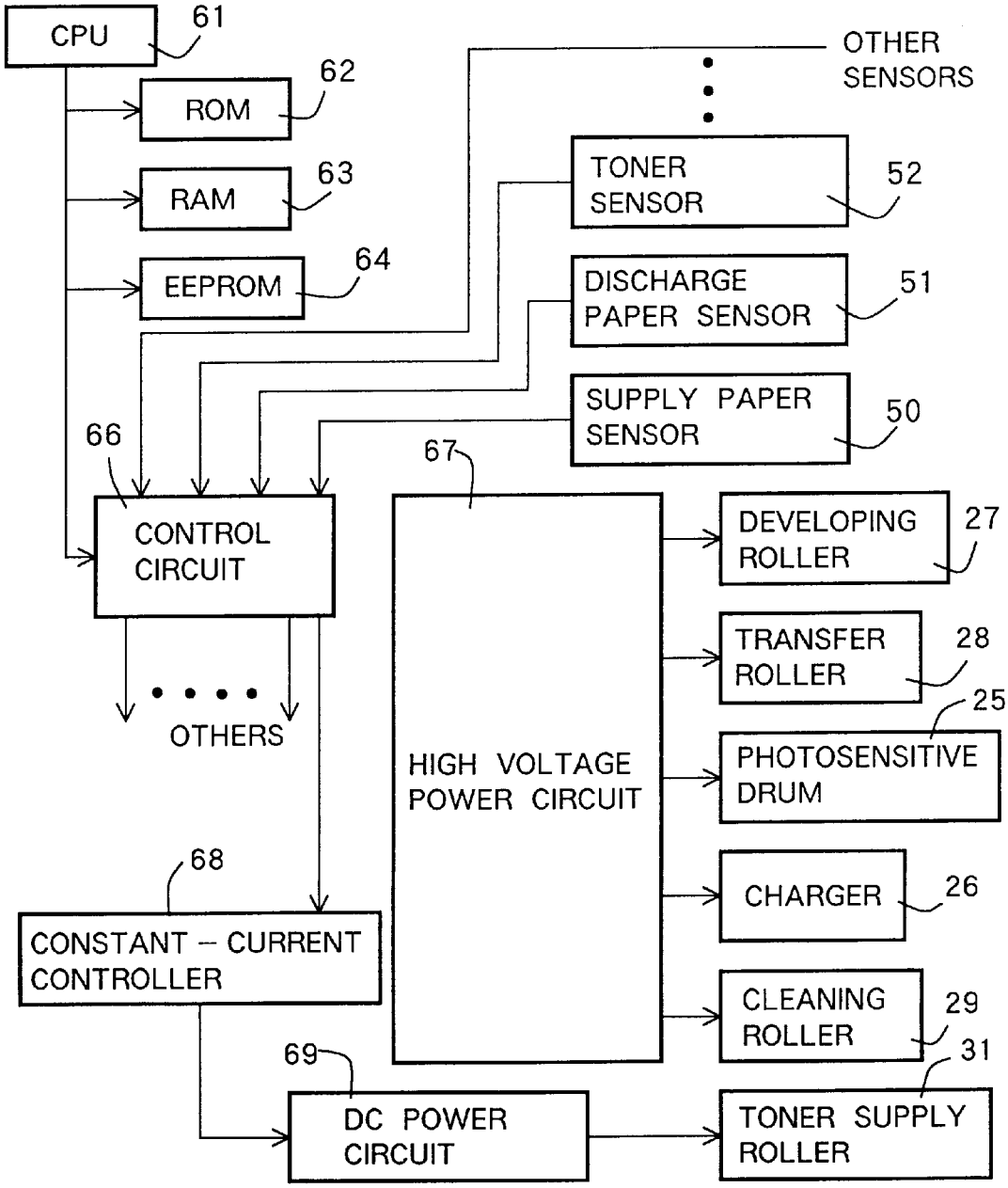
FIG. 3 is a block diagram showing a control system of the process unit of the laser printer in the first embodiment.

Control system of the process unit 7 in the first embodiment will be described with reference to FIG. 3. FIG. 3 is a block diagram showing the control system of the process unit 7 of the laser printer 1.

In FIG. 3, the laser printer 1 comprises a CPU 61 for controlling each component, a ROM 62 for storing control programs, a RAM 63 for storing process data and the like, an EEPROM 64 for storing a counted value relating to the number of printed sheets and others, a control circuit 66 constituted of ASIC and the like for controlling a high-voltage power circuit 67 and a constant-current controller 68, etc. To the control circuit 66 are connected the supply paper sensor 50, the discharge paper sensor 51, and the toner sensor 52 and the like. The laser printer 1 further comprises the high-voltage power circuit 67 for applying high bias voltage to the photosensitive drum 25, the charger 26, the developing roller 27, the transfer roller 28, and the cleaning roller 29 respectively, a direct-current (DC) power circuit 69 for applying bias voltage to the toner supply roller 31, and the constant-current controller 68 for controlling the DC power circuit 69 for a constant-current.

The CPU 61 controls the control circuit 66 in accordance with programs stored in the ROM 62 and various sensor values. Here, the roller shaft 27A of the developing roller 27 is applied bias voltage (about DC 700V in the present embodiment) at a constant voltage from the high-voltage power circuit 67 through the control circuit 66.

In the present embodiment, the toner having a positive electrification property is used. The voltage capable of causing toner to move to the developing roller 27 is applied to the toner supply roller 30, accordingly.

Figure 4A:
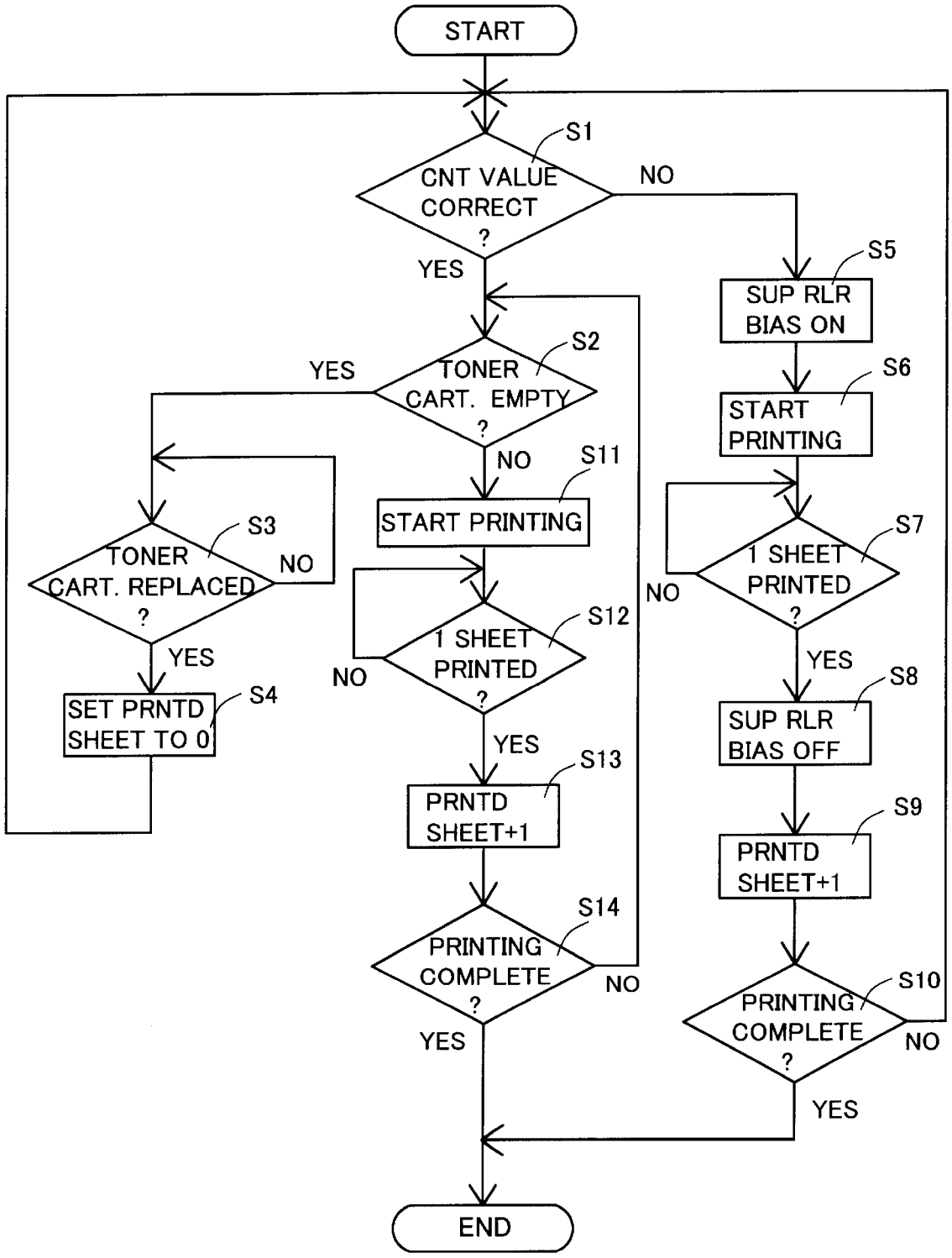
FIGS. 4(A) and (B) are a flowchart and a table of a process to apply bias voltage to a toner supply roller of the laser printer in the first embodiment.

Next, a process for applying bias voltage to the toner supply roller 31 of the process unit 7 in the laser printer 1 constructed as above will be explained, referring to FIG. 4. FIGS. 4(A) and (B) are a flowchart and a table of a process to apply bias voltage to the toner supply roller 31.

When the laser printer 1 receives a command to start printing, first, it reads a counted value representative of the number of printed sheets from the EEPROM 64 to judge whether or not it is larger than a predetermined value ("50" in the embodiment) (S1). When it is larger than "50" (S1: YES), the toner sensor 52 detects an amount of residual toner in the toner cartridge 54. If some amount of toner is detected (S2: NO), the toner supply roller 31 is caused to rotate upon detection on the passage of paper by the paper sensor 50, printing is started (S11). Next, the printing is continued until all data for one paper sheet are completely printed (S12: NO). Upon completion of printing for one paper sheet (S12: YES), this printed paper is discharged. When the sensor 51 detects the discharge of the paper, the counted value stored in the EEPROM 64 is added by "1" and stored again in the EEPROM 64 (S13). If a printing operation is not completed (S14: NO), detection on the toner amount in the toner cartridge 54 is repeated. When some toner remains therein (S2: NO), printing is conducted on the next paper sheet. The counted value of printed sheets is increased one by one every printed sheet (S11–S14). If the printing is completed (S14: YES), the toner supply roller 31 is caused to stop its rotation, and thus the printing operation is stopped.

On the other hand, when the counted value of printed sheets stored in the EEPROM 64, which is read after the laser printer 1 receives a print start command, is smaller than "50" (S1: NO), the CPU 61 causes the toner supply roller 31 to rotate and the constant-current controller 68 through the control circuit 66 to cause the DC power circuit 69 to apply bias voltage for a predetermined current value (2 $\mu$A in the embodiment) to the roller shaft 31A of the toner supply roller 31 (S5). Upon detection on the passage of the paper by the paper sensor 50, printing is started (S6) and continued until the completion of printing for one paper sheet (S7: NO). When the sensor 51 detects the discharge of the paper after completion of one-sheet printing (S7: YES), the CPU 61 causes the toner supply roller 31 to stop and the constant-current controller 68, through the control circuit 66, to turn off the DC power circuit 69 (S8). Subsequently, the counted value of printed sheets stored in the EEPROM 64 is added by "1" and stored in the EEPROM 64 again (S9). If the printing is continued (S10: NO), the CPU 61 reads the counted value of the printed sheets again from the EEPROM 64 and judges whether or not it is larger than "50" (S1) to continue printing. If the printing is completed (S10: YES), on the other hand, a printing operation is stopped.

When the counted value of printed sheets stored in the EEPROM 64, which is read after the laser printer 1 receives a print start command, is larger than "50" (S1: YES) and the toner sensor 52 detects that little toner remains in the toner cartridge 54, i.e., the toner cartridge 54 is empty (S2: YES), a printing operation is stopped to wait replacement of the toner cartridge 54 (S3: NO). After that, when the toner sensor 52 detects a sufficient amount of toner, the CPU 61 judges that the toner cartridge 54 has been replaced with new one (S3: YES) and puts the counted value of printed sheets stored in the EEPROM 64 into "0" and stores it again in the EEPROM 64 (S4).

In the process unit 7 in the present embodiment, in this way, the DC power circuit 69 for applying bias voltage to the roller shaft 31A of the toner supply roller 31 is controlled for a constant-current of 2 $\mu$A. Even if an insulating film and the like is formed on the surfaces of the toner supply roller 31 and the developing roller 27, accordingly, the current of 2 $\mu$A can be allowed to flow therebetween, so that the charged toner carried on the conductive sponge member 31B of the toner supply roller 31 can be surely transferred to the developing roller 27. This supplements black density to prevent the occurrence of fogging in a lower part of a high duty printed area such as a black solid area, thus enabling a uniform image formation with a good quality.

Furthermore, after detection of the replacement of the toner cartridge 54 by the toner sensor 52, the counted value of printed sheets is increased by "1" every after detection on the discharge of each printed sheet by the sensor 51. Until the counted value of printed sheets reaches "50" in the embodiment, the bias voltage is applied to the roller shaft 31A of the toner supply roller 31 according to the rotation time of the supply roller 31.

Accordingly, it is possible to prevent the transfer of poorly charged toner to the developing roller 27 at the replacement of the toner cartridge 54, thus resulting in a uniform image formation with a good image quality and enabling a reduction of consumption power of the image forming apparatus.

A second embodiment of the process unit of the laser printer according to the present invention will be described hereinafter. The schematic structure thereof is substantially the same as that in the first embodiment (see FIGS. 1 and 2).

Figure 5:
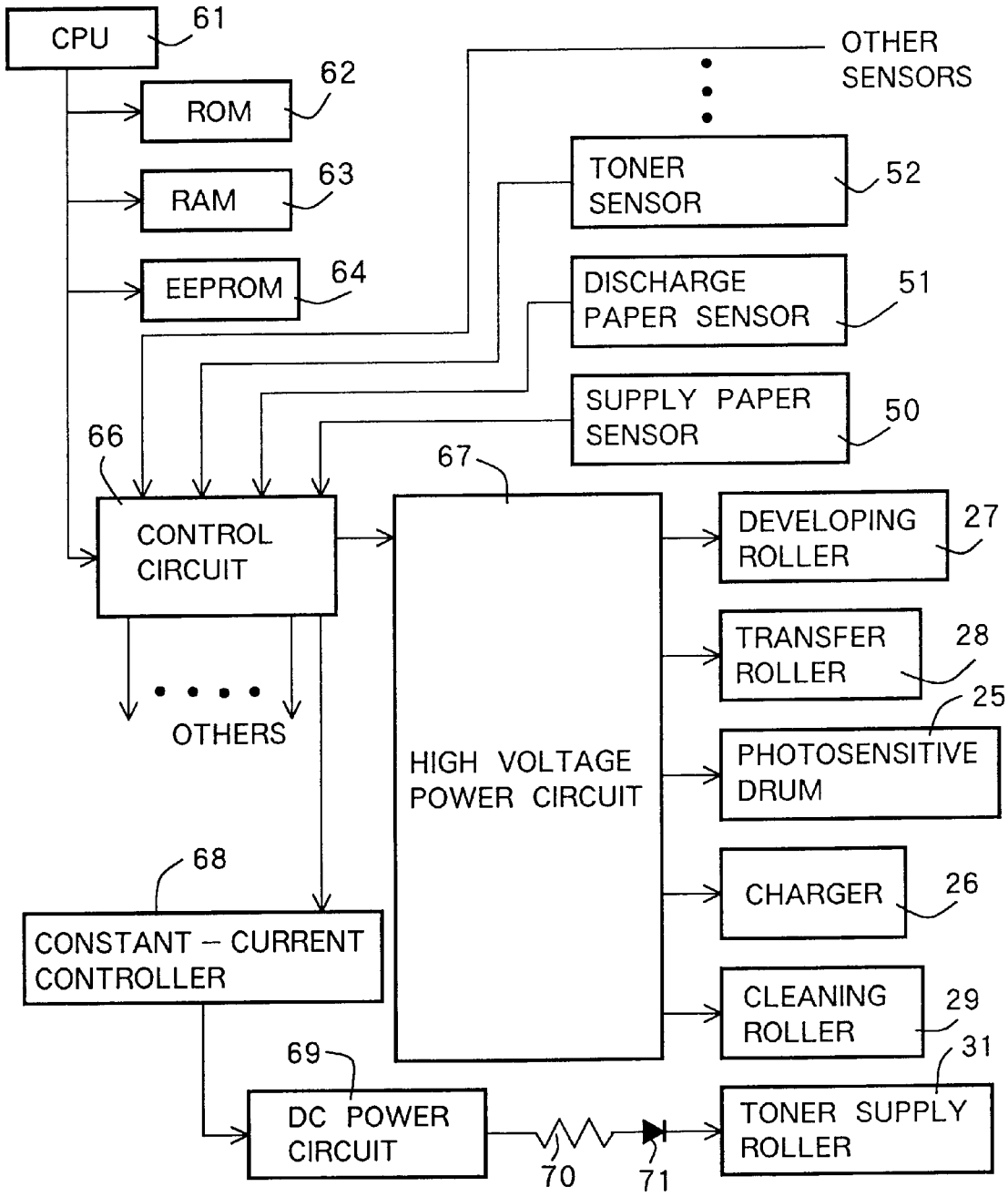
FIG. 5 is a block diagram showing a control system of the process unit of the laser printer in a second embodiment.

A control system of the process unit 7 in the second embodiment will be described hereinafter with reference to FIG. 5. FIG. 5 is a block diagram showing the control system of the process unit 7 in the second embodiment.

In FIG. 5, the laser printer 1 comprises a CPU 61 for controlling each component, a ROM 62 for storing control programs, a RAM 63 for storing process data and the like, an EEPROM 64 for storing a counted value representative of the number of printed sheets and others, a control circuit 66 constituted of ASIC and the like for controlling a high-voltage power circuit 67 and a constant-current controller 68, etc. To the control circuit 66 are connected the supply paper sensor 50, the discharge paper sensor 51, and the toner sensor 52 and the like. The laser printer 1 further comprises the high-voltage power circuit 67 for applying high bias voltage to the photosensitive drum 25, the charger 26, the developing roller 27, the transfer roller 28, and the cleaning roller 29 respectively, a direct-current (DC) power circuit 69 for applying bias voltage to the toner supply roller 31, the constant-current controller 68 for controlling the DC power circuit 69 for a constant-current, a resistor 70 which is connected in series with a circuit connecting the DC power circuit 69 and the toner supply roller 31, and a diode 71 which is connected to the circuit in a forward direction from the DC power circuit 69 to the toner supply roller 31.

The CPU 61 controls the control circuit 66 in accordance with programs stored in the ROM 62 and various sensor values. Here, the roller shaft 27A of the developing roller 27 is applied bias voltage (about DC 700V in the present embodiment) at a constant voltage from the high-voltage power circuit 67 through the control circuit 66.

Even if an inherent resistance value between the DC power circuit 69 and the toner supply roller 31 becomes minute, the output voltage of the DC power circuit 69, which is a constant-current circuit of 2 $\mu$A flow can become several hundred voltage (600V in the present embodiment) due to the resistor 70 having a large resistance value (about 300 M$\Omega$ in the embodiment) disposed therebetween. This output voltage is in a range that the DC power circuit 69 can control.

Since the diode 71 is connected, as mentioned above, in a forward direction between the DC power circuit 69 and the toner supply roller 31, the reverse current from the developing roller 27 can be prevented even if the electrical potential becomes 0V when the DC power circuit 69 is turned off, thus preventing transfer of the reversely charged toner to the developing roller 27.

In the present embodiment, the toner having a positive electrification property is used. The voltage capable of causing toner to move to the developing roller 27 is applied to the toner supply roller 30, accordingly.

Next, a process to apply bias voltage to the toner supply roller 31 of the process unit 7 in the second embodiment will be described below, referring to FIG. 4 as well as the first embodiment.

When the laser printer 1 receives a command to start printing, first, it reads a counted value representative of the number of printed sheets from the EEPROM 64 to judge whether or not it is larger than a predetermined value ("50" in the embodiment) (S1). When it is larger than "50" (S1: YES), the toner sensor 52 detects an amount of residual toner in the toner cartridge 54. If some amount of toner is detected (S2: NO), the toner supply roller 31 is caused to rotate upon detection on the passage of paper by the paper sensor 50, printing is started (S11). Next, the printing is continued until all data for one paper sheet are completely printed (S12: NO). Upon completion of printing for one paper sheet (S12: YES), this printed paper is discharged. When the sensor 51 detects the discharge of the paper, the counted value stored in the EEPROM 64 is added by "1" and stored again in the EEPROM 64 (S13). If a printing operation is not completed (S14: NO), detection on the toner amount in the toner cartridge 54 is repeated. When some toner remains therein (S2: NO), the printing is conducted on the next paper sheet. The counted value of printed sheets is increased one by one every printed sheet (S11–S14). If the printing is completed (S14: YES), the toner supply roller 31 is caused to stop its rotation, and thus the printing operation is stopped.

On the other hand, when the counted value of printed sheets stored in the EEPROM 64, which is read after the laser printer 1 receives a print start command, is smaller than "50" (S1: NO), the CPU 61 causes the toner supply roller 31 to rotate and the constant-current controller 68 through the control circuit 66 to cause the DC power circuit 69 to apply bias voltage for a predetermined current value (2 $\mu$A in the embodiment) to the roller shaft 31A of the toner supply roller 31 (S5). Upon detection on the passage of the paper by the paper sensor 50, printing is started (S6) and continued until the completion of printing for one paper sheet (S7: NO). When the sensor 51 detects the discharge of the paper after completion of one-sheet printing (S7: YES), the CPU 61 causes the toner supply roller 31 to stop and the constant-current controller 68, through the control circuit 66, to turn off the DC power circuit 69 (S8). Subsequently, the counted value of printed sheets stored in the EEPROM 64 is added by "1" and stored in the EEPROM 64 again (S9). If the printing is continued (S10: NO), the CPU 61 reads the counted value of the printed sheets again from the EEPROM 64 and judges whether or not it is larger than "50" (S1) to continue printing. If the printing is completed (S10: YES), on the other hand, a printing operation is stopped.

When the counted value of printed sheets stored in the EEPROM 64, which is read after the laser printer 1 receives a print start command, is larger than "50" (S1: YES) and the toner sensor 52 detects that little toner remains in the toner cartridge 54, i.e., the toner cartridge 54 is empty (S2: YES), a printing operation is stopped to wait replacement of the toner cartridge 54 (S3: NO). After that, when the toner sensor 52 detects a sufficient amount of toner, the CPU 61 judges that the toner cartridge 54 has been replaced with new one (S3: YES) and puts the counted value of printed sheets stored in the EEPROM 64 into "0" and stores it again in the EEPROM 64 (S4).

In the process unit 7 in the present embodiment, in this way, the DC power circuit 69 for applying bias voltage to the roller shaft 31A of the toner supply roller 31 is controlled for a constant-current of 2 $\mu$A. Even if an insulating film and the like is formed on the surfaces of the toner supply roller 31 and the developing roller 27, accordingly, the current of 2 $\mu$A can be allowed to flow therebetween, so that the charged toner carried on the conductive sponge member 31B of the toner supply roller 31 can be surely transferred to the developing roller 27. This supplements black density to prevent the occurrence of fogging in a lower part of a high duty printed area such as a black solid area, thus enabling a uniform image formation with a good quality.

Furthermore, after detection of the replacement of the toner cartridge 54 by the toner sensor 52, the counted value of printed sheets is increased by "1" every after detection on the discharge of each printed sheet by the sensor 51. Until the counted value of printed sheets reaches "50" in the embodiment, the bias voltage is applied to the roller shaft 31A of the toner supply roller 31 according to the rotation time of the supply roller 31.

This can prevent the poorly charged toner after the replacement of the toner cartridge 54 from being transferred to the developing roller 27, so that a constant image formation with a good image quality can be achieved and a reduction of power consumption of the image forming apparatus.

Since the resistor 70 having a large resistance value (about 300 MΩ in the present embodiment) is connected in series between the DC power circuit 69 and the toner supply roller 31, even when a resistance value between the circuit 69 and the roller 31 becomes minute, the output voltage of the DC power circuit 69 that is controlled for a constant current, 2 $\mu$A in the embodiment, by the constant-current controller 68 can become several hundred voltage (600 V or more in the embodiment). The output voltage can be made in a voltage range that the DC power circuit 69 can control.

Furthermore, in the second embodiment, the diode 71 is connected in series between the DC power circuit 69 and the supply roller 31 in a forward direction from the circuit 69 to the supply roller 31, which prevents the reverse current from the developing roller 27 even if the electric potential becomes 0V when the DC power circuit 69 is turned off. This can prevent the transfer of the reversely charged toner to the developing roller 27.

Next, a third embodiment of the process unit of the laser printer according to the present invention will be described hereinafter. The schematic structure thereof is substantially the same as that in the first embodiment (see FIGS. 1 and 2).

Figure 6:
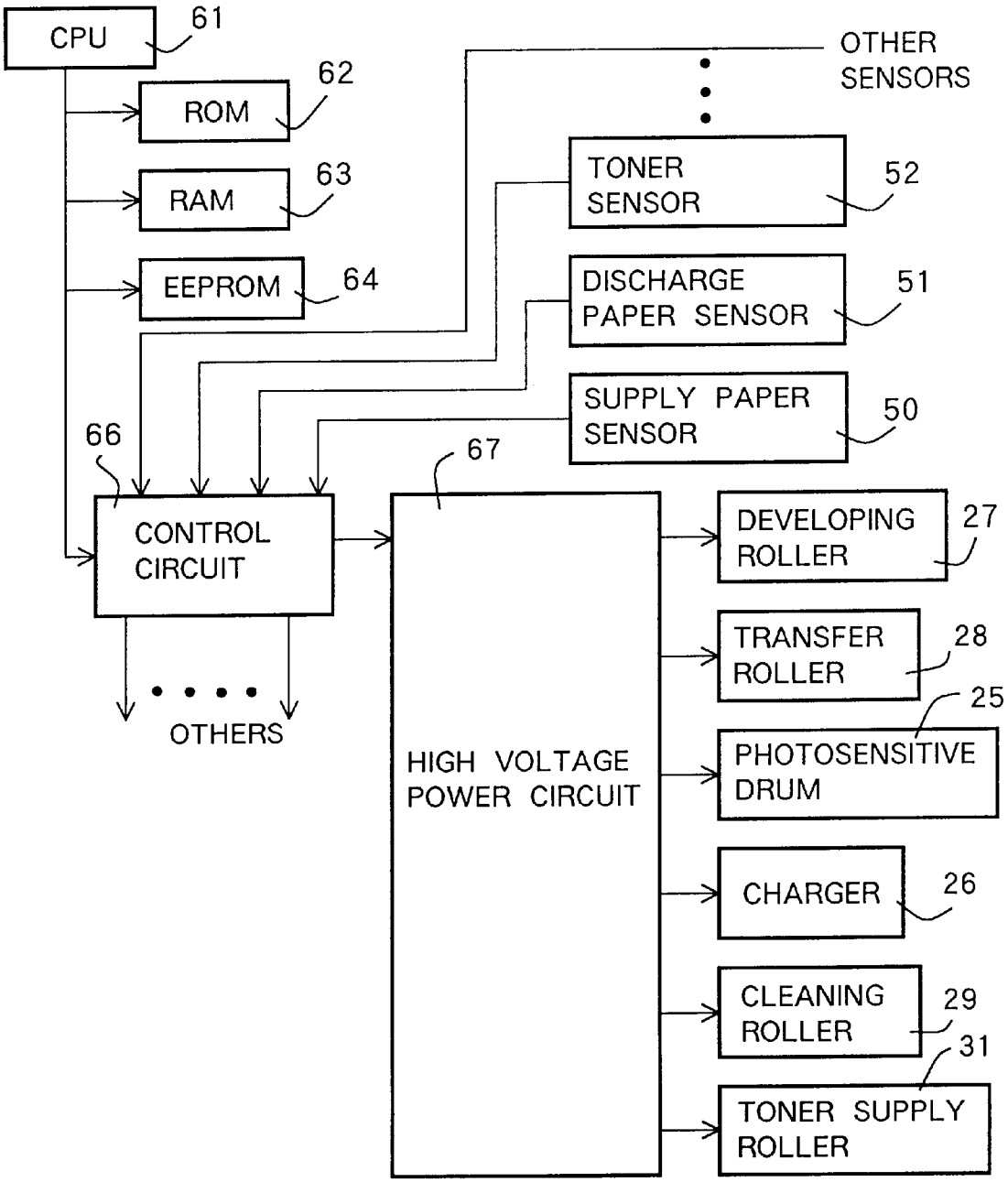
FIG. 6 is a block diagram showing a control system of the process unit of the laser printer in a third embodiment.

A control system of the process unit 7 in the third embodiment will be described hereinafter with reference to FIG. 6. FIG. 6 is a block diagram showing the control system of the process unit 7 in the third embodiment.

In FIG. 6, the laser printer 1 comprises a CPU 61 for controlling each component, a ROM 62 for storing control programs, a RAM 62 for storing process data and the like, an EEPROM 64 for storing reference values relating to the cumulative number of printed sheets, a count value representative of the number of printing sheets for which bias voltage is to be applied to the toner supply roller, which is selected in accordance with the reference value, a counted value representative of the number of printed sheets, and a counter memory for storing a counted value representative of the cumulative number of printed paper sheets counted after replacement of the process unit, etc., a control circuit 66 constituted of ASIC and the like for controlling a high-voltage power circuit 67 and a constant-current controller 68, and others. To the control circuit 66, connected are sensors such as the supply paper sensor 50, the discharge paper sensor 51, and the toner sensor 52. The laser printer 1 further comprises the high-voltage power circuit 67 for applying high bias voltage to the photosensitive drum 25, the charger 26, the developing roller 27, the transfer roller 28, and the cleaning roller 29.

The CPU 61 controls the control circuit 66 in accordance with programs stored in the ROM 62 and various sensor values. Here, the roller shaft 27A of the developing roller 27 is applied a constant bias voltage (about DC 700V in the third embodiment) by the high-voltage power circuit 67 through the control circuit 66. The roller shaft 31A of the toner supply roller 31 is also applied a constant bias voltage (about DC 800 V in the third embodiment) by the high-voltage power circuit 67 through the control circuit 66. Since the toner having a positive electrification property is used in the present embodiment, accordingly, the voltage causing the toner to move to the developing roller 27 is applied to the toner supply roller 31.

Figure 7A:
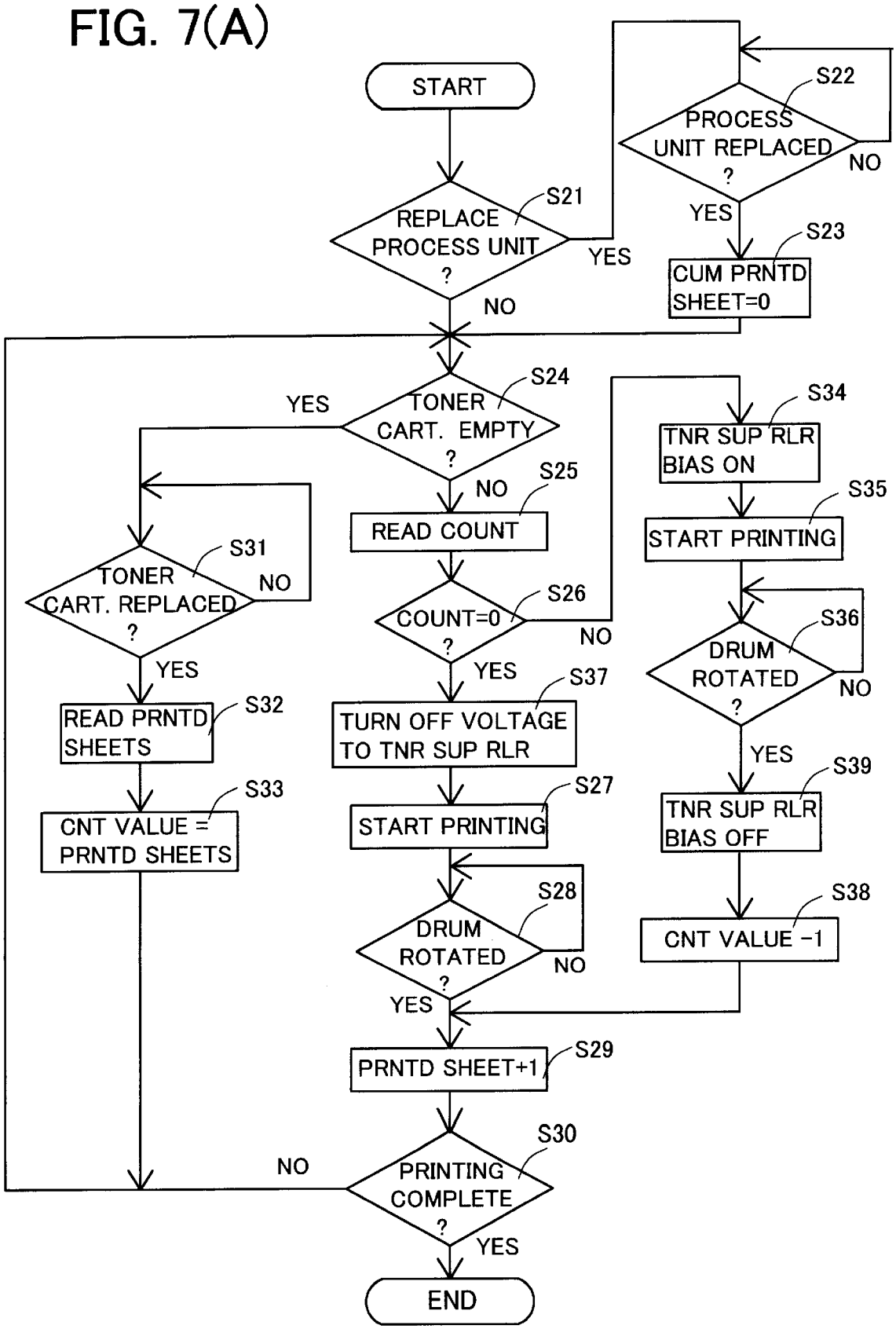
FIGS. 7(A) and (B) are a flowchart and a table of a process to apply bias voltage to a toner supply roller of the laser printer in the third embodiment.

Next, a process for applying bias voltage to the toner supply roller 31 of the process unit 7 in the laser printer 1 constructed as above in the third embodiment will be explained referring to FIGS. 7 and 8. FIGS. 7(A) and (B) are a flowchart and a table of the process to apply bias voltage to the toner supply roller 31. FIG. 8 is a data table showing count values representative of the number of printing paper sheets for which bias voltage is applied to the toner supply roller 31 every after the replacement of the toner cartridge 54, which are determined according to the cumulative number of printed sheets.

Here, the count value representative of the number of printing sheets determined in correspondence with the cumulative number of printed sheets will be explained with reference to FIG. 8.

The cumulative number of rotation of the photosensitive drum 25 is converted into the cumulative number of printed sheets, wherein a rotating amount of the drum 25 for printing on a sheet of paper is considered as one printed sheet. Referring to FIG. 8, when the cumulative number of printed sheets is "0", the number of printing sheets for which bias voltage is applied to the toner supply roller 31 after the replacement of the toner cartridge 54 is "0". Similarly, when the cumulative number is in a range of 1–1000, the number of printing sheets for which bias voltage is applied to the supply roller 31 is "10". When the cumulative number is in 1001–2500, the number is "20". When the cumulative number is 2501–5000, the number is "30". When the cumulative number is 5001–8000, the number is "40". When the cumulative number is 8001–9000, the number is "50". And when the cumulative number is more than 9001, the number is "60".

The laser printer 1 first reads a counted value representative of the cumulative number of printed sheets from the EEPROM 64 and detects whether it is larger than a predetermined value thereby to judge whether the current process unit 7 should be replaced with new one (S21). If no replacement of the process unit 7 is needed (i.e., the counted value of the cumulative number of printed sheets is less than a predetermined value) (S21: NO), the toner sensor 52 is caused to detect an amount of the toner remaining the toner cartridge 54 (S24).

Alternatively, if replacement of the process unit 7 is needed (i.e., the counted value of the cumulative number of printed sheets is more than the predetermined value) (S21: YES), the process unit 7 is replaced with new one (S22: YES), and the cumulative number is changed to "0" and stored in the EEPROM 64 (S23). Sequentially, the toner sensor 52 is caused to detect an amount of residual toner in the toner cartridge 54 (S24).

When the toner sensor 52 detects that some amount of toner remains in the toner cartridge 54 (S24: NO), the CPU 61 reads a count value of printing sheets from the EEPROM 64 (S25) to detect whether the count value representative of the number of printing sheets is "0" (S26). If the count value is "0" (S26: YES), the CPU 61 turns off the voltage to be applied to the toner supply roller (S37) and causes the toner supply roller 31 to rotate to start printing (S27). While detecting whether the photosensitive drum 25 has been rotated by an amount corresponding to one printing sheet by a timer not shown of the control circuit 66, the CPU 61 controls to continue printing until the drum 25 has been rotated for one printing sheet (S28: NO). When the drum 25 has been rotated for one printing sheet (S28: YES), the CPU 61 adds "1" to the counted value representative of the cumulative number of printed sheets stored in the EEPROM 64 and stores it again in the EEPROM 64 (S29). If the printing is not completed (S30: NO), then, the toner sensor 52 is caused to detect an amount of residual toner in the toner cartridge 54 (S24) to continue the printing operation. If the printing is completed (S30: YES), the toner supply roller 31 is caused to stop and thus the printing operation is finished.

When the count value is not "0" (S26: NO), on the other hand, the CPU 61 drives the toner supply roller 31 to rotate and the high-voltage power circuit 67 through the control circuit 66 to apply a constant bias voltage (about DC 800 V in the third embodiment) to the roller shaft 31A of the supply roller 31 (S34). Then, printing is started (S35). Similarly to above, using the timer (not shown) of the control circuit 66, it is judged whether the photosensitive drum 25 has been rotated by an amount corresponding to one printing sheet. The printing operation is continued until the drum 25 has been rotated for one printing sheet (S36: NO). Upon detection on the rotation of the photosensitive drum 25 for one printing sheet by the timer of the control circuit 66 (S36: YES), the CPU 61 stops the high-voltage power circuit 67 through the control circuit 66 (S39) and the rotation of the toner supply roller 31, and subtracts "1" from the count value stored in the EEPROM 64 and stores it again in the EEPROM 64 (S38), and sequentially adds "1" to the counted value of the cumulative number of printed sheets stored in the EEPROM 64 and stores it again in the EEPROM 64 (S29).

If the printing is not completed (S30: NO), the toner sensor 52 is caused again to detect an amount of the residual toner in the toner cartridge 54 (S24), the printing operation is then repeated. If the printing is completed (S30: YES), the printing operation is stopped.

When the toner sensor 52 detects that no toner remains in the toner cartridge 54 (S24: YES), the printing operation is stopped to wait replacement of the toner cartridge 54 with new one (S31: NO). When the toner sensor 52 detects that a sufficient amount of toner remains in the toner cartridge 54, the CPU 61 judges that the replacement of the toner cartridge 54 with new one has been completed (S31: YES) and reads the counted value representative of the cumulative number of printed sheets from the counter memory of the EEPROM 64 and also reads, using the table of FIG. 8, the number of printing sheets for which bias voltage is applied to the toner supply roller 31 for the reference value corresponding to the cumulative number of printed sheets from the EEPROM 64 (S32) to store the number of printing sheets as a new count value in the EEPROM 64 (S33).

The toner sensor 52 then detects an amount of the residual toner in the toner cartridge 54 (S24) and the printing operation is continued.

As described above, in the process unit 7 in the third embodiment, upon detection on the replacement of the toner cartridge 54, the CPU 61 reads from the EEPROM 64 the number of printing sheets for which bias voltage is applied to the toner supply roller 31 after the replacement of the toner cartridge 54, which corresponds to the cumulative number of printed sheets, and it stores the number of printing sheets as a new count value in the EEPROM 64. Next, the CPU 61 controls to apply bias voltage to the roller shaft 31A during the rotation of the photosensitive drum 25 until the drum 25 has been rotated by an amount corresponding to the count value.

Accordingly, even if a deterioration of toner charging ability of the developing roller 27 and an increase of deteriorated toner remaining in the developing chamber 40 resulted from aging of the process unit 7 due to a long working time, the time for applying bias voltage to the roller shaft 31A of the toner supply roller 31 can properly be regulated in correspondence with the deterioration of toner charging ability of the developing roller 27 and the residual amount of the deteriorated toner, whereby the poorly charged toner occurring after the replacement of the toner cartridge 54 can be effectively prevented from adhering to the developing roller 27 in order to achieve a constant image formation with a good image quality.

Since the number of rotation of the photosensitive drum 25 for printing on a sheet of paper is considered as the number of printed paper being "1", actual working time of the developing roller 27 and the toner supply roller 31 can be detected even if the detected number of actually printed sheets does not correspond to the number of rotation of the photosensitive drum 25 due to any passing trouble of the paper in printing.

Furthermore, the bias voltage is applied to the roller shaft 31A only during the rotation of the photosensitive drum 25 until the predetermined number of printed sheets is counted, so that a reduction in power consumption of the laser printer 1 can be achieved.

Next, the process unit 7 of the laser printer 1 in a fourth embodiment will be described. The schematic structure of the laser printer 1 is substantially the same as that in the first embodiment (see FIGS. 1 and 2). The process unit 7 in the fourth embodiment has substantially the same control system as that in the second embodiment shown in FIG. 5. The details thereof will be omitted hereinafter, accordingly.

Figure 9A:
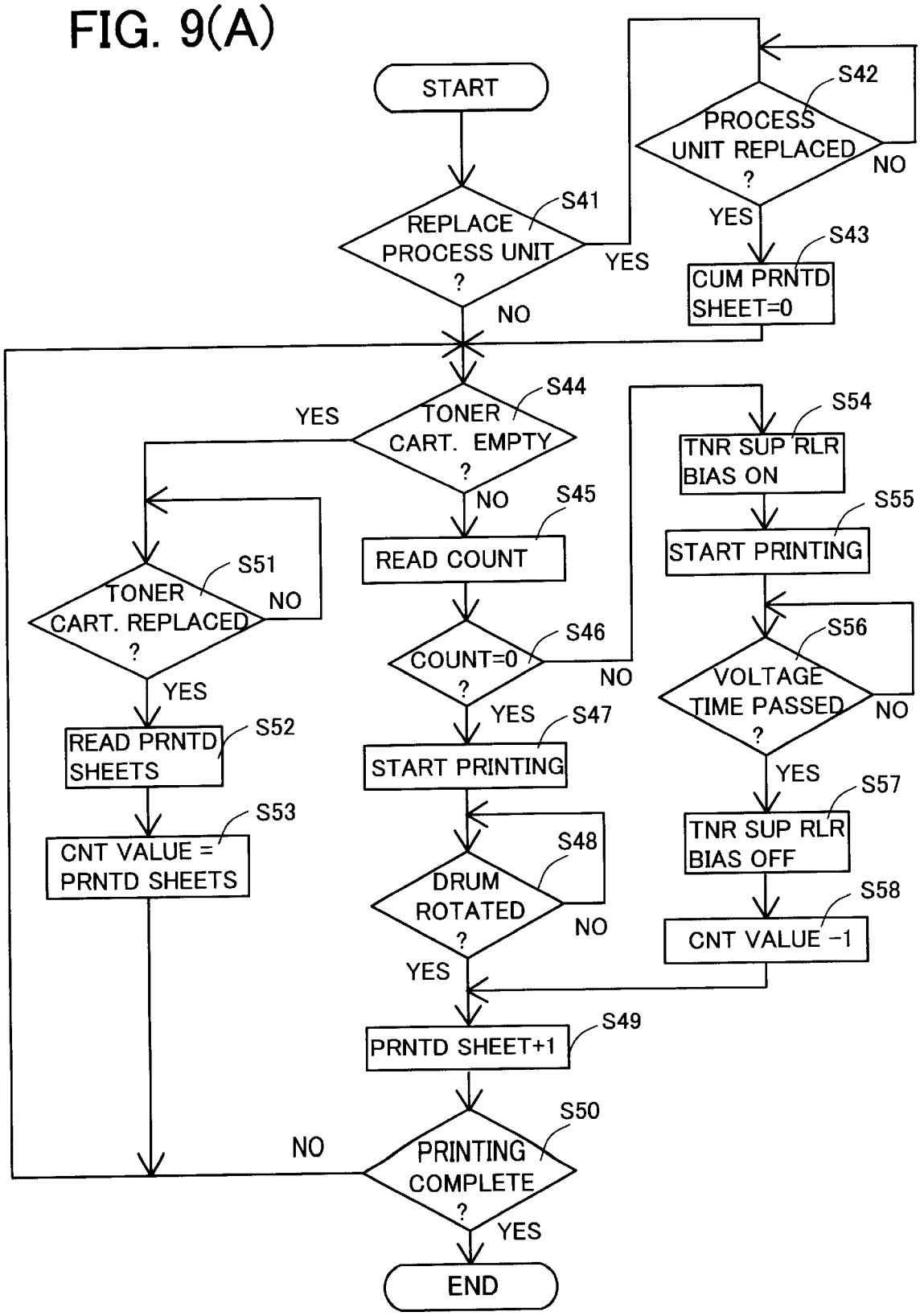
FIGS. 9(A) and (B) are a flowchart and a table of a process to apply bias voltage to a toner supply roller of the laser printer in a fourth embodiment.
Figure 10:
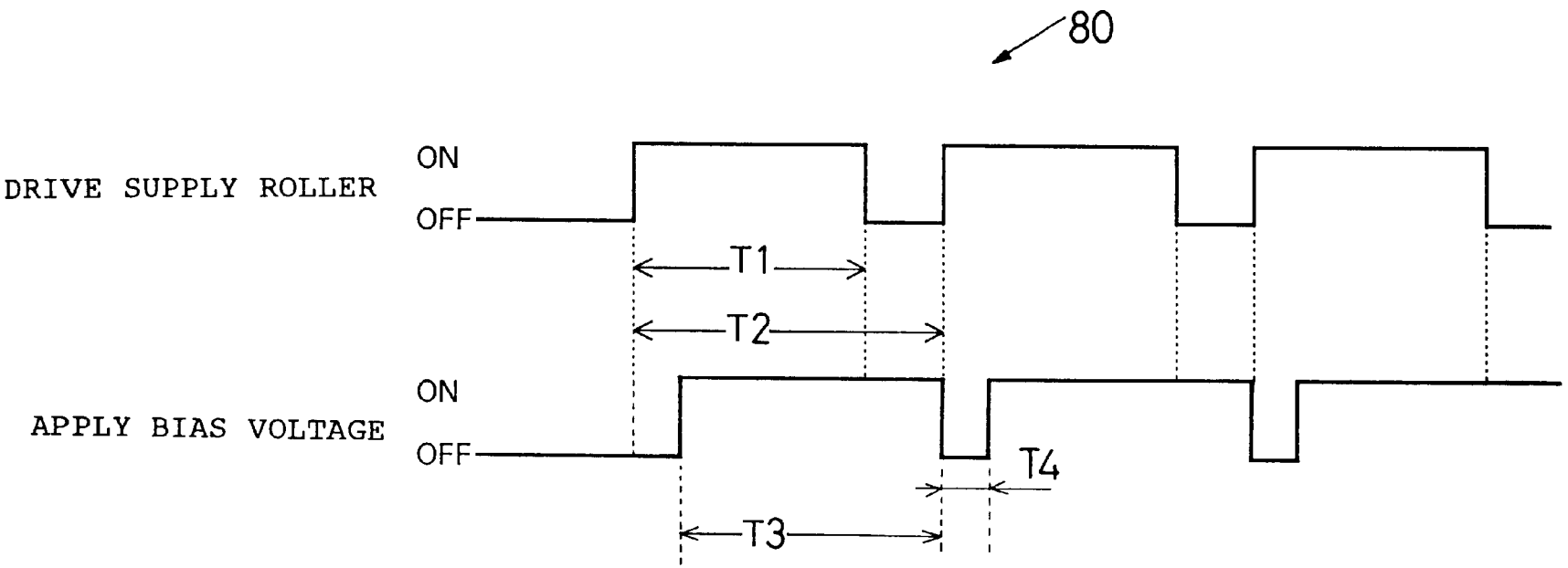
FIG. 10 is a timing chart to apply bias voltage to the toner supply roller in the fourth embodiment.
Figure 11:
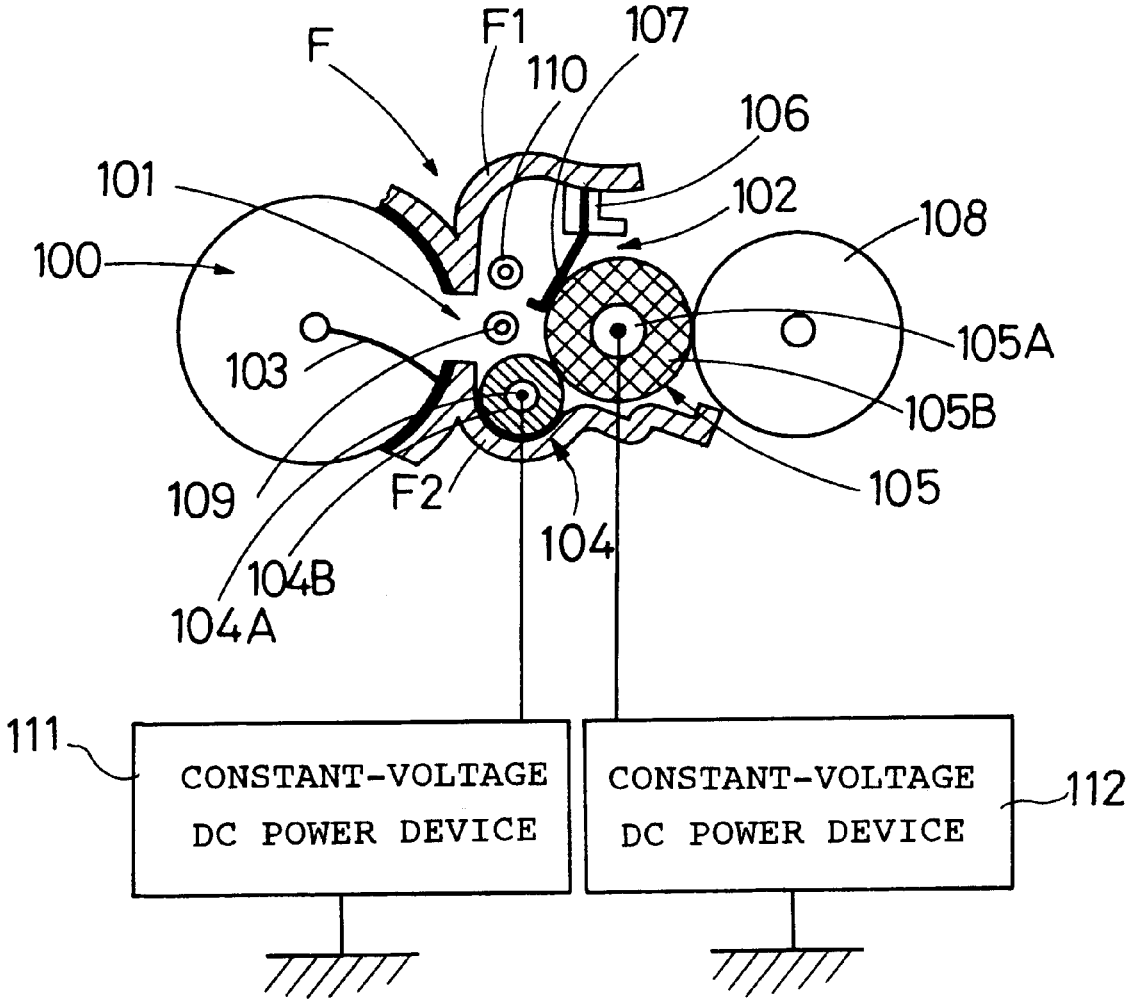
FIG.11 PRIOR ART
FIG. 11 is a schematic sectional side view of a main part of a developing device for an image forming apparatus in the prior art.

A process for applying bias voltage to the toner supply roller 31 of the process unit 7 in the fourth embodiment will be explained hereinafter, referring to FIGS. 9 and 10. FIGS. 9(A) and (B) are a flowchart and a table of the process for applying bias voltage to the toner supply roller 31. FIG. 10 is a timing chart to apply bias voltage to the toner supply roller 31. It is noted that the fourth embodiment also utilizes the data table used in the third embodiment, showing reference values relating to the cumulative number of printed sheets and the number of printing sheets for which bias voltage is applied to the toner supply roller 31 after replacement of the toner cartridge 54, which is determined according to the reference value (see FIG. 8).

The laser printer 1 first reads a counted value representative of the cumulative number of printed sheets from the counter memory of the EEPROM 64 and detects whether it is larger than a predetermined value thereby to judge whether the current process unit 7 should be replaced with new one (S41). If no replacement of the process unit 7 is needed (i.e., the counted value of the cumulative number of printed sheets is less than a predetermined value) (S41: NO), the toner sensor 52 is caused to detect an amount of toner remaining in the toner cartridge 54 (S44).

Alternatively, if replacement of the process unit 7 is needed (i.e., the counted value of the cumulative number of printed sheets is more than the predetermined value) (S41: YES), the process unit 7 is replaced with new one (S42: YES), and the cumulative number is changed to "0" and stored in the EEPROM 64 (S43). Sequentially, the toner sensor 52 is caused to detect an amount of residual toner in the toner cartridge 54 (S44).

When the toner sensor 52 detects that some amount of toner remains in the toner cartridge 54 (S44: NO), the CPU 61 reads a count value from the EEPROM 64 (S45) to detect whether the count value is "0" (S46). If the count value is "0" (S46: YES), the CPU 61 starts printing upon detection on the passage of the paper by the sensor 50 (S47). While detecting that the photosensitive drum 25 has been rotated by an amount corresponding to a sheet of paper by a timer not shown of the control circuit 66, the CPU 61 controls to continue printing until the drum 25 has been rotated by the above amount (S48: NO). Upon completion of rotation of the drum 25 for a sheet of paper(S48: YES), the CPU 61 adds "1" to the counted value of the cumulative number of print ed sheets stored in the EEPROM 64 and stores it again in the EEPROM 64 (S49). If the printing is not completed (S50: NO), then, the toner sensor 52 is caused to detect an amount of the residual toner in the toner cartridge 54 (S44) to continue the printing operation. If the printing is completed (S50: YES), the printing operation is finished.

When the count value is not "0" (S46: NO), on the other hand, the CPU 61 drives the high-voltage power circuit 67 through the control circuit 66 to apply a constant bias voltage (about DC 800 V in the fourth embodiment) to the roller shaft 31A of the supply roller 31 (S54). Then, printing is started (S55). When the printing paper sheet is fed to be printed and the sensor 50 detects the paper, a time measuring device (not shown) starts time measurement. The time measurement is continued for time T3 following time T4, during which printing is conducted while bias voltage is being applied to the toner supply roller 31 (S56: NO). This time T3 is set to be longer than time T1 for feeding a sheet of paper from its head to bottom end and to partially overlap with the time T1 during which the supply roller is rotated. The time T3 is also set to be shorter than time T2 which is a time between a printing start time with respect to a paper sheet and the next printing start time with respect to the next paper sheet in the case of a sequential printing for a plurality of paper sheets.

When time T3 has passed (S56: YES), the CPU 61 causes the control circuit 66 to turn off the high-voltage power circuit 67 (S57) to stop application of bias voltage to the toner supply roller 31. The CPU 61 subtract "1" from the count value stored in the EEPROM 64 and stores it again in the EEPROM 64 (S58), and adds "1" to the counted value of the cumulative number of printed sheets stored in the EEPROM 64 and stores it again in the EEPROM 64 (S49). If the printing is not completed (50: NO), the toner sensor 52 is caused to detect an amount of the residual toner in the toner cartridge 54 (S44) to continue the printing operation. If the printing is completed (S50: YES), alternatively, the printing operation is finished.

When the toner sensor 52 detects that no toner remains in the toner cartridge 54 (S44: YES), the printing operation is stopped to wait replacement of the toner cartridge 54 with new one (S51: NO). When the toner sensor 52 detects that sufficient toner remains in the toner cartridge 54, the CPU 61 judges that the replacement of the toner cartridge 54 with new one has been completed (S51: YES) and reads the number of printing sheets for which bias voltage is applied to the toner supply roller 31 after the replacement of the toner cartridge, which is in correspondence with the cumulative number of printed sheets (see FIG. 10) from the EEPROM 64 (S52) and stores the number of printing sheets as a new count value in the EEPROM 64 (S53). The toner sensor 52 then detects an amount of residual toner in the toner cartridge 54 (S44) and the printing operation is continued.

As described above, in the process unit 7 in the fourth embodiment, upon detecting the replacement of the toner cartridge 54, the CPU 61 reads from the EEPROM 64 the number of printing sheets for which bias voltage is applied to the toner supply roller 31 after the replacement of the toner cartridge 54, which corresponds to the cumulative number of printed sheets (see FIG. 8), and stores the number of printing sheets as a new count value in the EEPROM 64. Next, when the sensor 50 detects the feeding of the paper sheet to be printed, the time measuring device (not shown) starts time measurement, the CPU 61 conducts constant-current control to apply bias voltage for a predetermined value of current (2 $\mu$A in the fourth embodiment), through the resistor 70 and the diode 71 to the roller shaft 31A of the toner supply roller 31 until the time T3 following time T4 has passed.

Accordingly, even if a deterioration of toner charging ability of the developing roller 27 and an increase of deteriorated toner remaining in the developing chamber 40 resulted from aging of the process unit 7 due to a long working time, the time during which bias voltage is applied to the roller shaft 31A of the toner supply roller 31 can properly be regulated according to the deterioration of toner charging ability of the developing roller 27 and the residual amount of the deteriorated toner, whereby the poorly charged toner produced after the replacement of the toner cartridge 54 can be effectively prevented from adhering to the developing roller 27 in order to achieve a constant image formation with a good image quality.

As mentioned above, the DC power device for applying bias voltage to the roller shaft 31A of the toner supply roller 31 is controlled to provide a constant current, which allows current of a predetermined value (2 $\mu$A in the fourth embodiment) to flow between the toner supply roller 31 and the developing roller 27 even when an insulating film and the like is formed on the surface of the toner supply roller 31 or the developing roller 27, ensuring the adequate supply of charged toner carried on the conductive sponge member 31B of the supply roller 31 to the developing roller 27. This can achieve a constant image formation with a good image quality.

The reverse current between the toner supply roller and the developing roller can be prevented even if the DC power device is turned off.

The current of a predetermined current value, for example, 2 $\mu$A is allowed to pass between the toner supply roller 31 and the developing roller 27, which supplements black density to prevent the occurrence of fogging in a lower part of a high duty printed area such as a black solid area, thus resulting in an image formation with a good quality.

Furthermore, bias voltage is applied to the roller shaft 31A of the toner supply roller 31 during the time T3 from a start of rotation of the toner supply roller 31, so that the bias voltage is applied to the toner carried on the conductive sponge member 31B of the toner supply roller 31 in a wider area than the image forming area.

Since the number of rotation of the photosensitive drum 25 is converted into the number of printed sheets by considering the number of rotation of the drum 25 to a sheet of paper as that the number of printed sheet is one, the actual working time of the developing roller 27 and the toner supply roller 31 can be detected even if the detected number of actually printed sheets is not equal to the number of rotation of the photosensitive drum 25 due to any passing trouble of the paper in printing.

The bias voltage is applied to the roller shaft 31A of the toner supply roller 31 during the time T3 from a printing start time for each paper sheet, until the number of printed sheet corresponding to the count value is counted after the replacement of the toner cartridge 54, which results in a reduction of power consumption of the laser printer 1.

The present invention may be embodied in other specific forms without departing from the spirit or essential characteristics thereof. For instance, the following may be adopted.

(a) The above embodiment utilizes the photosensitive drum 25; however, instead thereof, an endless belt type of photosensitive drum may be used.

(b) The above embodiment uses the positively charged toner, but may use the negatively charged toner. In the case of the negatively charged toner, bias voltage for applying negative charge to toner may be applied to the toner supply roller 31. In this case, the diode 71 is connected in series in a reverse direction.

(c) In the above embodiment, the bias voltage to be applied after the replacement of the toner cartridge 54 is put to 0V after printing by the predetermined number of printed sheets; however, a voltage lower than the applied voltage may be applied. In the case of the use of the negatively charged toner, a higher voltage than the applied voltage may be applied.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated.

It is intended that the scope of the invention be defined by the claims appended hereto, and their equivalents.

What is claimed is:

1. A developing device for an image forming apparatus for performing an image formation by an electrophotography process, the developing device comprising:

a unit frame;

a toner storing portion disposed inside the unit frame;

a photosensitive body disposed in the unit frame;

a developing roller for supplying toner to an electrostatic latent image formed on the photosensitive body to develop it, disposed rotatably around a roller shaft and facing the photosensitive body;

a first voltage application device for applying a first bias voltage to the roller shaft of the developing roller;

a supply roller for supplying toner from the toner storing portion to the developing roller, disposed rotatably around a roller shaft and facing the developing roller;

a second voltage application device for applying a second bias voltage to the roller shaft of the supply roller so as to cause charged toner to move from the supply roller to the developing roller;

first detection means for detecting whether a predetermined time has elapsed after an initiation of a supply roller rotation; and control means for regulating the second bias voltage applied to the roller shaft of the supply roller by the second voltage application device when the first detection means detects that the predetermined time has elapsed.

2. A developing device according to claim 1, wherein the first detection means detects that the predetermined time has elapsed by detecting a number of printed paper sheets on which the image formation is performed through the photosensitive body, and the control means regulates the second bias voltage to turn on/off the second voltage application device until the first detection means detects that the number of printed paper sheets has reached a predetermined value.

3. A developing device according to claim 2, wherein the control means turns on/off the second voltage application device every time the image formation is performed on a sheet of printing paper.

4. A developing device according to claim 2, further comprising second detection means for detecting whether the toner storing portion has been supplied with toner, wherein the first detection means detects the number of printed paper sheets after the toner supply to the toner storing portion is detected by the second detection means.

5. A developing device according to claim 4, wherein the second voltage application device changes the second bias voltage when the first detection means detects that the number of printed paper sheets has reached the predetermined value.

6. A developing device according to claim 2, wherein the supply roller is caused to rotate and stop every time the image formation is performed on a sheet of printing paper, and the control means turns on/off the second voltage application device according to a rotation time of the supply roller.

7. A developing device for an image forming apparatus for performing an image formation by an electrophotography process, the developing device comprising:

a unit frame;

a toner storing portion disposed inside the unit frame;

a photosensitive body disposed in the unit frame;

a developing roller for supplying toner to an electrostatic latent image formed on the photosensitive body to develop it, disposed rotatably around a roller shaft and facing to the photosensitive body;

a first voltage application device for applying a first bias voltage to the roller shaft of the developing roller;

a supply roller for supplying toner from the toner storing portion to the developing roller, disposed rotatably around a roller shaft and facing to the developing roller;

a second voltage application device for applying a second bias voltage to the roller shaft of the supply roller so as to cause charged toner to move from the supply roller to the developing roller;

first detection means for detecting a number of printed paper sheets on which the image formation is performed through the photosensitive body;

second detection means for detecting whether the toner storing portion has been supplied with toner;

judgement means for judging whether the number of printed paper sheets detected by the first detection means reaches a predetermined value; and control means for applying the second bias voltage to the roller shaft of the supply roller through the second voltage application device until the judgement means detects that the number of printed paper sheets has reached the predetermined value after the second detection means detects that the toner storing portion has been supplied with toner.

8. A developing device according to claim 7, wherein the control means turns on/off the second voltage application device every time the image formation is performed on a sheet of printing paper.

9. A developing device according to claim 7, further comprising:

a first memory for storing reference values relating to a cumulative number of printed paper sheets, and a number of printing paper sheets for which the second voltage application device applies the second bias voltage in correspondence with the reference number;

a second memory for increasing cumulatively the number of printed paper sheets detected by the first detection means and stores it;

wherein the judgement means compares the cumulative number of printed paper sheets stored in the second memory with the reference value stored in the first memory, and reads, based on a comparison result thereof, the number of printing paper sheets for which the second bias voltage is to be supplied, and the control means causes the second voltage application device to apply the second bias voltage to the roller shaft of the supply roller until the number of printed paper sheets detected by the first detection means has reached the number of printing sheets determined by the judgement means.

10. A developing device according to claim 9, further comprising a constant-current controller for conducting constant-current control of the second voltage application device to apply the second bias voltage having a predetermined current value from the second voltage application device to the roller shaft of the supply roller.

11. A developing device according to claim 10, further comprising:

a resistor connected in series between the roller shaft of the supply roller and the constant-current controller; and a diode connected in series between the resistor and the roller shaft of the supply roller.

12. A developing device according to claim 11, wherein the constant-current controller applies the second bias voltage having the predetermined current value from the second voltage application device to the roller shaft of the supply roller through the resistor and the diode.

13. A developing device according to claim 12, wherein a resistance value of the resistor is set to be approximately 300 M≠.

14. A developing device according to claim 13, wherein the second bias voltage is set to be approximately 700 volts (V) and the first bias voltage is set to be approximately 800 volts (V).

15. A developing device according to claim 11, wherein constant-current value controlled by the constant-current controller is set to be 2 $\mu$A or less.

16. A developing device according to claim 7, wherein the first detection means detects the number of printed paper sheets based on a moving amount of the photosensitive body.

17. A developing device according to claim 7, wherein the supply roller is caused to rotate and stop every time the image formation is performed on a sheet of printing paper, and the control means turns on/off the second voltage application device per a time partially overlapping with a rotation time of the supply roller.

18. A developing device according to claim 17, wherein the rotation time of the supply roller is in correspondence with a time required for feeding a sheet of printing paper.

19. A developing device according to claim 18, wherein set is a sequential image-formation time from a start of the image formation on a printing paper sheet up to a next start of the image formation on a next printing paper sheet, and the voltage application time is set to be longer than the feeding time and shorter than the sequential image-formation time.

20. A developing device according to claim 1, further comprising:

a constant-current controller for controlling the second voltage application device to apply a predetermined current value to the roller shaft of the supply roller.

21. A developing device according to claim further comprising:

a resistor connected in series between the roller shaft of the supply roller and the constant-current controller; and a diode connected in series between the resistor and the roller shaft of the supply roller.

22. A developing device according to claim 21, wherein the constant-current controller applies the second bias voltage having a predetermined current value from the second voltage application device to the roller shaft of the supply roller through the resistor and the diode.

23. A developing device according to claim 22, wherein a resistance value of the resistor is set to be approximately 300 MΩ.

24. A developing device according to claim 23, wherein the second bias voltage is set to be several hundred volts (V).

25. A developing device according to claim 24, wherein the second bias voltage is set to be approximately 600 volts (V).

26. A developing device according to claim 20, wherein a constant-current value controlled by the constant-current controller is set to be 2 $\mu$A or less.

* * * * *